US009190235B2

(12) United States Patent
Wiryana et al.

(10) Patent No.: US 9,190,235 B2
(45) Date of Patent: Nov. 17, 2015

(54) MANUFACTURABILITY OF SMD AND THROUGH-HOLE FUSES USING LASER PROCESS

(75) Inventors: Sidharta Wiryana, Kowloon (HK); Tianyu Zhu, Shanghai (CN)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 479 days.

(21) Appl. No.: 11/967,161

(22) Filed: Dec. 29, 2007

(65) Prior Publication Data

US 2009/0167480 A1 Jul. 2, 2009

(51) Int. Cl.

*H01H 69/02* (2006.01)
*H01H 85/046* (2006.01)
*H01H 85/041* (2006.01)

(52) U.S. Cl.

CPC ..... *H01H 69/022* (2013.01); *H01H 85/0411* (2013.01); *H01H 85/046* (2013.01); *H01H 2069/025* (2013.01); *H01H 2085/0414* (2013.01); *Y10T 29/49107* (2015.01)

(58) Field of Classification Search

CPC ..... H01H 69/022; H01H 85/0411; H01H 2069/025; H01H 2085/0414; H01H 85/046; Y10T 29/49107

USPC ..... 337/297, 198, 290, 295, 14, 186, 159, 337/228; 361/104, 626; 29/623

See application file for complete search history.

(56) References Cited

U.S. PATENT DOCUMENTS 4,198,744 A * 4/1980 Nicolay ..... 438/601
4,460,888 A * 7/1984 Gratton et al. ..... 337/290
4,582,659 A * 4/1986 Hilgers ..... 427/101
5,166,656 A 11/1992 Badihi et al.
5,367,280 A * 11/1994 Thiel et al. ..... 337/297
5,760,674 A * 6/1998 Gilmour et al. ..... 337/297
6,002,322 A * 12/1999 Krueger et al. ..... 337/297
6,023,028 A 2/2000 Neuhalfen (Continued)

FOREIGN PATENT DOCUMENTS

DE 8908139 10/1989
EP 0270954 6/1988

(Continued)

OTHER PUBLICATIONS

International Search Report and Written Opinion of PCT/US2008/088399; Jun. 26, 2009; 19 pages.

*Primary Examiner* — Anatoly Vortman
(74) *Attorney, Agent, or Firm* — Armstrong Teasdale LLP

(57) ABSTRACT

The invention relates to a method of manufacturing a circuit protector and to a circuit protector. The method comprises the steps of providing a substrate having opposing end portions, coupling an element layer to the top surface of the substrate, and laser machining the element layer to shape the element layer into a predetermined geometry. The circuit protector comprises a substrate having opposing end portions, termination pads coupled to the top surface at opposing end portions of the substrate, a fuse element disposed across a space between the termination pads and electrically connecting the termination pads, the fuse element having a predetermined geometry; the predetermined geometry having the narrowest width of about 0.025 to about 0.050 millimeters, a cover coupling the top surface and suffusing the substrate, the fuse element and the termination pads, and end terminations in electrical contact with the termination pads at the opposing end portions.

31 Claims, 7 Drawing Sheets

(56) References Cited

U.S. PATENT DOCUMENTS

| | | | | |
|---|---|---|---|---|
| 2003/0076643 | A1* | 4/2003 | Chu et al. | 361/93.9 |
| 2003/0142453 | A1* | 7/2003 | Parker et al. | 361/104 |
| 2004/0034993 | A1* | 2/2004 | Rybka et al. | 29/623 |
| 2004/0169578 | A1* | 9/2004 | Jollenbeck et al. | 337/227 |
| 2004/0183646 | A1* | 9/2004 | Jollenbeck et al. | 337/228 |
| 2004/0184211 | A1* | 9/2004 | Bender et al. | 361/104 |
| 2004/0196135 | A1* | 10/2004 | Clair | 337/198 |
| 2005/0087522 | A1* | 4/2005 | Sun et al. | 219/121.71 |
| 2005/0141164 | A1* | 6/2005 | Bender et al. | 361/104 |
| 2005/0212647 | A1* | 9/2005 | Goldsberry et al. | 337/198 |
| 2005/0218122 | A1* | 10/2005 | Yamamoto et al. | 219/121.61 |
| 2006/0055497 | A1* | 3/2006 | Harris et al. | 337/14 |
| 2006/0170528 | A1* | 8/2006 | Fukushige et al. | 337/297 |
| 2006/0175309 | A1* | 8/2006 | Danzer | 219/121.64 |
| 2006/0192845 | A1* | 8/2006 | Cordingley et al. | 347/252 |
| 2006/0214259 | A1 | 9/2006 | Spaunhorst | |
| 2006/0255019 | A1* | 11/2006 | Martukanitz et al. | 219/121.64 |
| 2006/0255897 | A1* | 11/2006 | Tanaka et al. | 336/83 |
| 2007/0173075 | A1* | 7/2007 | Lee et al. | 438/795 |
| 2007/0216514 | A1* | 9/2007 | Ohtsuka et al. | 337/404 |
| 2008/0303626 | A1* | 12/2008 | Blum et al. | 337/297 |

FOREIGN PATENT DOCUMENTS

| | | |
|---|---|---|
| FR | 2081828 | 12/1971 |
| FR | 2528617 | 12/1983 |
| JP | 2002279883 | 9/2002 |

* cited by examiner

MANUFACTURABILITY OF SMD AND THROUGH-HOLE FUSES USING LASER PROCESS

BACKGROUND OF THE INVENTION

This invention relates generally to a circuit protector and, more particularly, to SMD and through-hole fuses and methods of manufacturing SMD and through-hole fuses. In particular, the present invention may be used in connection with all standard sizes of surface mountable devices and through-hole fuses including, but not limited to, 1206, 0805, 0603 and 0402 fuses, as well as with all non-standard fuse sizes. U.S. application Ser. No. 11/091,665, entitled, "Hybrid Chip Fuse Assembly Having Wire Leads And Fabrication Method", which was published on Sep. 28, 2006 as U.S. Publication No. 20060214259, relates to through-hole fuses and is incorporated by reference herein.

Subminiature circuit protectors are useful in applications in which size and space limitations are important, for example, on circuit boards for electronic equipment, for denser packing and miniaturization of electronic circuits.

Ceramic chip type fuses are typically manufactured by depositing an element layer on a ceramic or glass substrate plate, screen printing the element layer, printing the element layer to a predetermined thickness and width to obtain a certain resistance, attaching an insulating cover over the element layer, and cutting, or dicing, individual fuses from the finished structure. The element layer loses definition when the screen printing operation is performed. The screen printing operation is not very accurate and the edge acuity of the resulting element layer is not very good. Photolithography etching may be used as an alternative to the screen printing operation, but this process is relatively expensive due to additional required processing steps and the longer lead times.

There is a need for a method of manufacturing a subminiature circuit protector that is simple and relatively inexpensive. Additionally, there is also a need for a method of manufacturing a subminiature circuit protector, wherein the element layer may be designed to a certain geometry and also has a fine edge acuity.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

Figure 1:
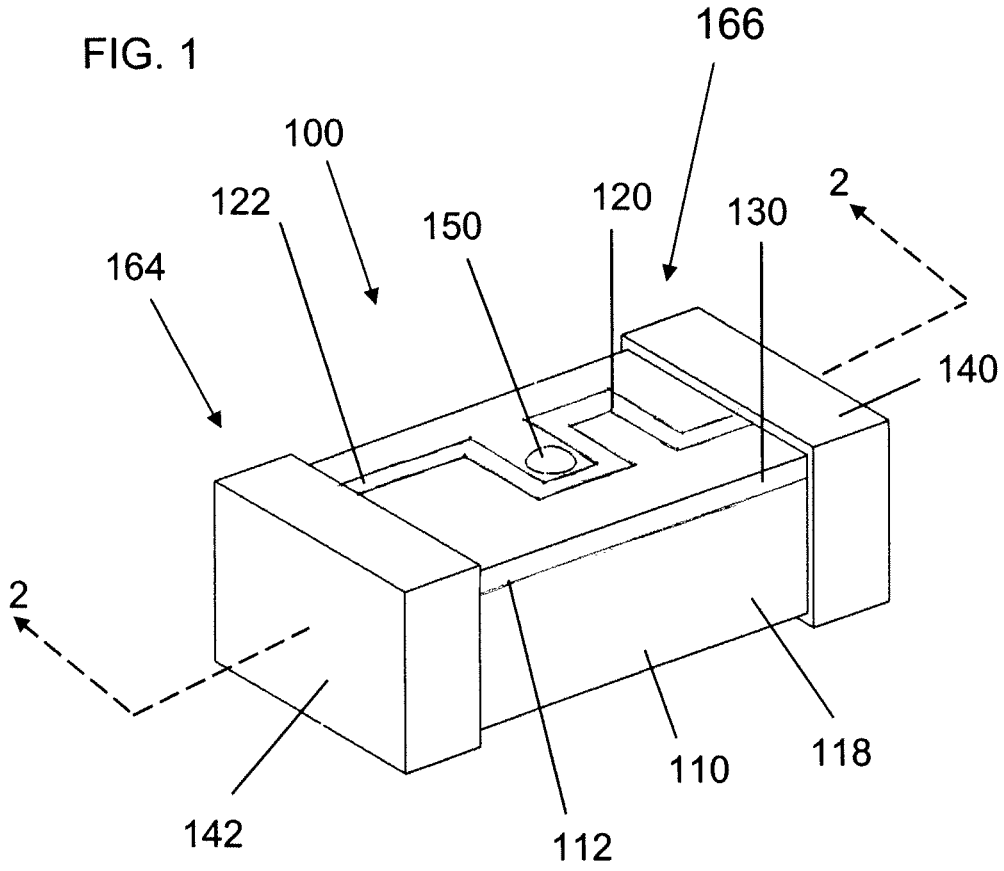
FIG. 1 illustrates a perspective view of a circuit protector in accordance with certain exemplary embodiments of the present invention.

FIG. 1 illustrates a perspective view of a circuit protector 100 in accordance with an exemplary embodiment. It is understood that the figures are not to scale, and that the thickness of the various components has been exaggerated for the purpose of clarity.

The circuit protector 100 comprises a substrate 110 of electrically insulating material, an element layer 120 of electrically conductive material coupled to the top surface 112 of the substrate 110, a cover 130 coupled to at least a portion of the element layer 120, and electrically conductive termination ends 140, 142 coupled to opposing end portions 116, 117 of the substrate 110. The termination ends 140, 142 are electrically coupled to the element layer 120, so as to form a circuit pathway through the circuit protector 100. Additionally, a marking 150 may be coupled to the surface of the cover 130. Marking 150 may include symbols or colors for identifying certain characteristics of the fuse. These characteristics may include, but is not limited to, the technology used to make the fuse, the footprint of the fuse, electrical characteristics of the fuse and ampere rating of the fuse. In an alternative embodiment, the cover 130 may be coupled to at least a portion of the element layer 120 and to at least a portion of the substrate 110.

Figure 2:
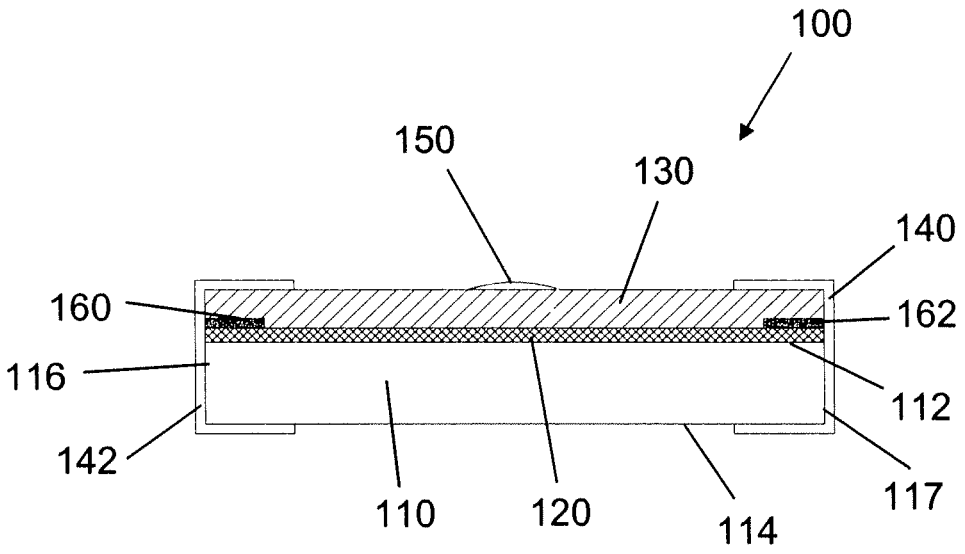
FIG. 2 illustrates a side cross-sectional view of the circuit protector of FIG. 1, taken along line 2-2 in accordance with certain exemplary embodiments of the present invention.

FIG. 2 illustrates a side cross-sectional view of the circuit protector 100 of FIG. 1 taken along line 2-2 in accordance with an exemplary embodiment. It may be seen that the circuit protector 100 further comprises electrical termination pads 160, 162 coupled to the element layer 120 (e.g., on the top surface thereof). Termination ends 140, 142 cover the opposing end portions 116, 117 of the substrate 110 and are electrically coupled to the termination pads 160, 162. The termination ends 140, 142 thus form the external electrical terminals for connecting the circuit protector 100 in a circuit (not shown).

In certain embodiments, the element layer 120 may comprise termination pads 160, 162 and a fuse element 122 disposed between and electrically connecting the termination pads 160, 162. The termination pads 160, 162 and the fuse element 122 may be a monolithic structure that is formed from the element layer 120. Additionally, the fuse element 122 and the termination pads 160, 162 may each have a predetermined thickness. For example, the thickness of the termination pads 160, 162 may be at least the thickness of the fuse element 122.

In other embodiments, termination pads 160, 162 may be formed separately from and electrically coupled to the element layer 120.

Figure 3:
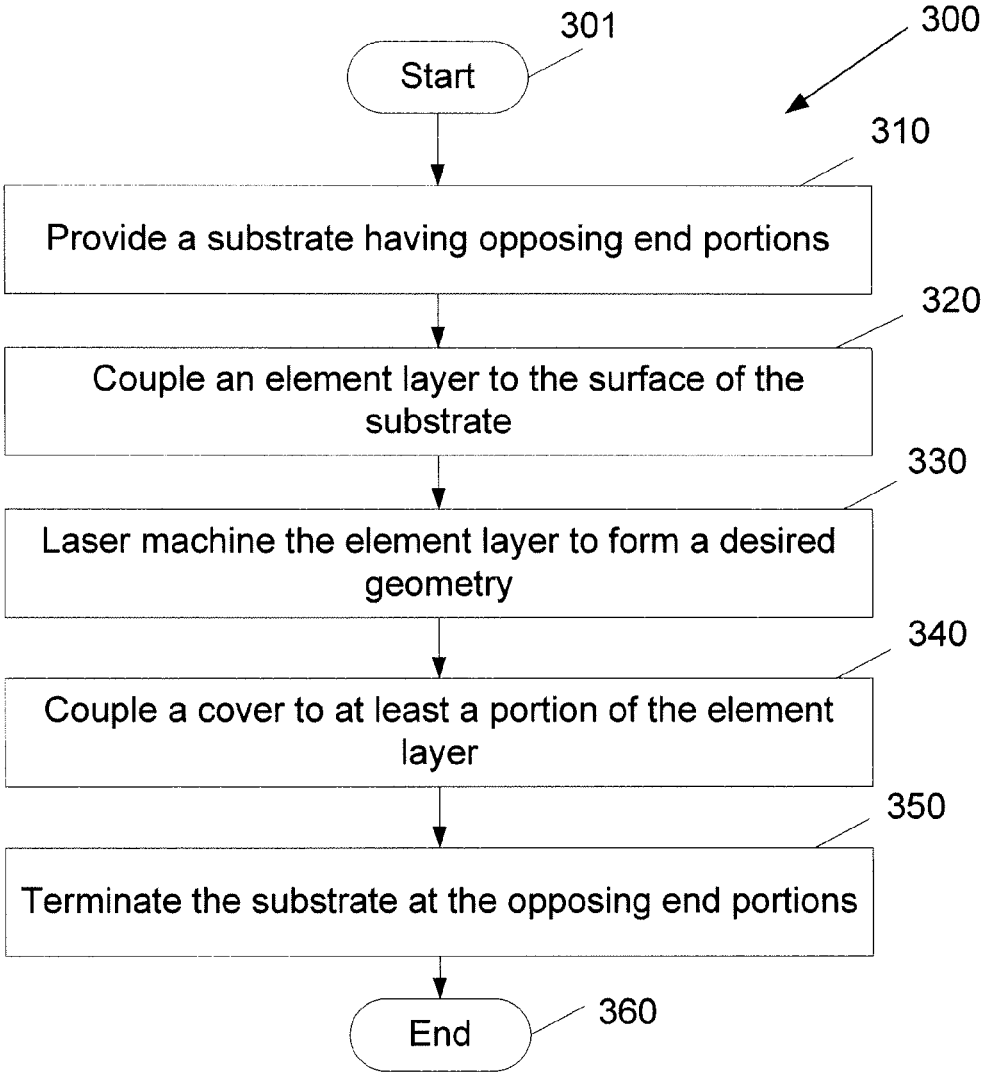
FIG. 3 is a flowchart depicting an exemplary method of manufacturing a circuit protector.

Having briefly described the structure of the circuit protector 100 in accordance with certain exemplary embodiments, an exemplary method for manufacturing a circuit protector in accordance with the present invention will now be described with respect to FIG. 3 and FIGS. 4A-4J. FIG. 3 is a flowchart depicting an exemplary method 300 of manufacturing a circuit protector 100. FIGS. 4A-4J illustrate a single exemplary circuit protector 100 during various stages of manufacture, such as in accordance with the exemplary method 300 described with reference to FIG. 3.

Figure 4A:
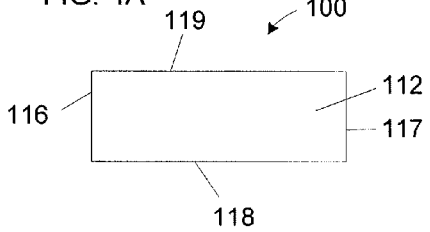
FIGS. 4A-4J illustrate a circuit protector during various stages of manufacture in accordance with certain exemplary embodiments of the present invention.
Figure 4B:
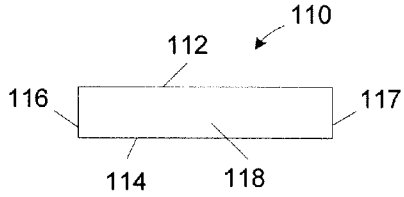

The exemplary method 300 begins at step 301 and advances to step 310, where a substrate 110 having opposing end portions 116, 117 is provided. In certain embodiments, the provided substrate 110 may be roughly the size of one circuit protector. The top view and the side view of the substrate 110, which forms the basis for a single circuit protector 100 are illustrated in FIG. 4A and FIG. 4B, respectively. The substrate 110 may be formed of any suitable electrically insulative material, including, but not limited to, ceramic, glass, polymer materials such as polyimide, FR4, alumina, steatite, forsterite, or a mixture thereof. In the illustrated embodiment, the substrate is formed in a substantially rectangular cross-sectional shape. However, in alternative embodiments, the substrate 110 may be formed in other sizes and shapes without departing from the scope and spirit of the invention. The substrate 110 has a top surface 112, a bottom surface 114, opposing end portions 116, 117, and opposing lateral edges 118, 119. In some embodiments, the top surface 112 of the substrate 110 is substantially planar.

Figure 4C:
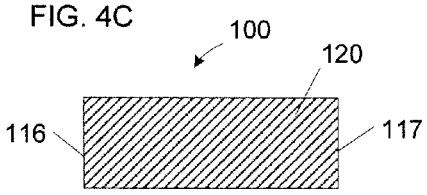
Figure 4D:
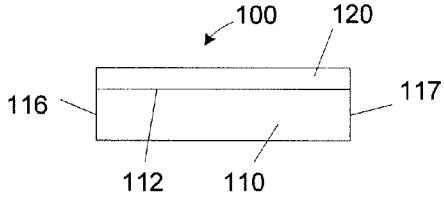

Next at step 320, an element layer 120 is coupled to the top surface 112 of the substrate 110 by suitable means, as is known in the art. The top view and the side view of the substrate 110 and element layer 120 are illustrated in FIG. 4C and FIG. 4D, respectively. The element layer 120 may be made of any suitable electrically conductive material, which may include, but is not limited to, silver, gold, palladium silver, copper, nickel or any alloys thereof.

In certain embodiments, glass frit is typically included in the element layer 120 and is used as an adhesive to couple the element layer 120 to the substrate 110. In such embodiments, the element layer 120 may be applied onto the top surface 112 of the substrate 110 in liquid form, which would result in the glass frit settling to the bottom of the element layer 120. As described above, the termination pads 160, 162 may be formed as part of the element layer 120. Alternatively, the termination pads 160, 162 may be formed separately from the element layer 120. Other known methods for applying the element layer 120 to the substrate 110, including, but not limited to, thick film methods, thin film methods, sputtering methods, and laminating film methods, may be employed at step 320 without departing from the scope and spirit of the present invention.

The chosen thickness of the element layer 120 may vary greatly depending upon the desired characteristics (e.g., resistance) of the circuit protector 100, which are typically dictated by application requirements. For example, when applying the element layer 120 as a thin film, the thickness may be about 0.2 microns. However, when applying the element layer 120 as a thick film, the thickness may be about 12 microns to about 15 microns.

Figure 4E:
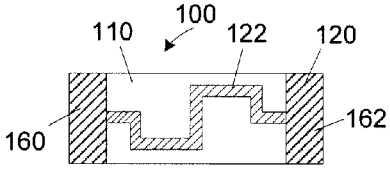
Figure 4F:
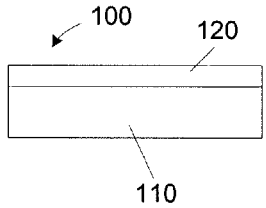

At step 330, the element layer 120 is laser machined to a predetermined geometry. This predetermined geometry defines the time current characteristics of the resulting fuse element 122. The top view and the side view of the substrate 110 and the element layer 120 laser machined to a predetermined geometry are illustrated in FIG. 4E and FIG. 4F, respectively. FIG. 4E shows the geometry of the element layer 120 to be substantially serpentine. The termination pads 160, 162 may also be formed from the element layer 120 by way of laser machining.

Laser machining allows the element layer 120 to be formed into various complex geometries while maintaining fine edge acuity and allowing for sharp right angles or curves along the sidewalls of the geometry. Thus, the sidewalls have a 90° cut when the element layer 120 is laser machined. Accordingly, laser machining allows for the fuse element 122 to be thicker in depth and narrower in width, when compared to SMD fuses of the prior art. The fuse element manufactured via laser machining may have a reduced number of pin holes, when compared to current manufacturing processes. Pin holes are approximately 0.05 mm-0.2 mm diameter holes which result from air bubbles in the ink during printing and firing processes. This reduced number of pin holes results in reducing the nuisance blows. Additionally, laser machining may enhance the circuit protector performance due to better localized heating of the fuse element 122, which reduces the heat dissipation into the substrate 110.

By way of example (and not by way of limitation), laser machining technology can be used to produce a fuse element geometry in which the width of the narrowest portion of the fuse element 122 may be as small as about 0.025 mm, while still maintaining a fine edge acuity. Additionally, the narrowest vaporized width surrounding the narrowest portion of the fuse element 122 may be as small as about 0.019 mm and still maintain a fine edge acuity. Those skilled in the art will appreciate that laser machining can also be used to produce fuse element geometries having larger or smaller widths, which choice of which will typically depend upon application requirements for the circuit protector 100, without departing from the scope and spirit of the present invention.

In certain embodiments of the present invention, a YLP Series Laser, manufactured by IPG Photonics Corporation, is used to perform the laser machining. One suitable model in the YLP Series is the YLP-0.5/80/20 model. The wavelength, power, beam quality and spot size are some of the parameters that determine the laser machining dynamics. This model is a ytterbium fiber laser that utilizes a pulsed mode of operation and delivers 0.5 millijoules per pulse. The pulse width is about 80 nanoseconds. These lasers deliver a high power 1060 to 1070 nanometer wavelength laser beam, which is not within the visible spectrum, directly to the worksite via a flexible metal-sheathed fiber cable. The laser provides low heat so that the element layer 120 may be laser machined without damaging the substrate 110 during the laser machining process. Additionally, the laser beam is collimated and is typically focused to a spot size of a few microns or less. Furthermore, the output fiber delivery length is about 3-8 meters. The pulse repetition rate for this laser ranges from 20-100 kHz. Additionally, the nominal average output power of this laser is about 10 W, while the maximum power consumption is about 160 W.

Fiber lasers have wide dynamic operating power range and the beam focus and its position remain constant, even when the laser power is changed, allowing for consistent processing results every time. A wide range of spot sizes may also be achieved by changing the optics configuration. These features enable the user to choose an appropriate power density for cutting various materials and wall thicknesses.

The high mode quality and small spot size of the fiber laser with optimized pulses facilitate laser machining of intricate features and geometries in thin material. This pulsed mode-cutting results in minimal slag and HAZ, which are very critical to many micro-machining applications. High power density associated with small spot sizes of the fiber laser also translates into faster cutting with superior edge quality.

These fiber lasers allow the undesired metallization of the element layer 120 to be vaporized and still maintain the fine geometry that is required for optimum performance of the fuse element 122. When such a fiber laser is used on gold, the focal point is about 15 micrometers. However, when the laser is used on silver, the focal point is about 20-25 micrometers. Since gold is not as reflective as silver, it is easier to cut. Depending upon the properties of the element layer, the fiber laser may have a focal point that is about 10 micrometers. A smaller focal point may be achieved by limiting the light emitting area. In alternative embodiments, another type of fiber laser or another type of laser may be used without departing from the scope and spirit of the present invention, so long that the laser produces fine resolution on the element layer 120 without damaging substrate 110.

Figure 4G:
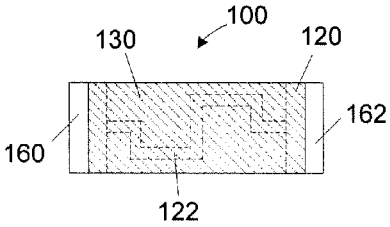
Figure 4H:
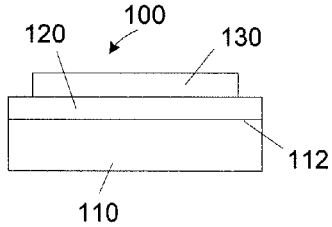

After the element layer 120 is laser machined in step 330, a cover 130 is coupled to at least a portion of the element layer 120 in step 340. The top view and the side view of the substrate 110, element layer 120 and cover 130 are illustrated in FIG. 4G and FIG. 4H, respectively. The cover 130 may be formed of glass or ceramic or other electrically insulating suitable material. The cover 130 suffuses at least a portion of the top surface 112 of the substrate 110, the fuse element 122, and at least a portion of the termination pads 160, 162, and fills any voids around and between them. In an alternative embodiment, the cover 130 is coupled to at least a portion of the element layer 120 and to at least a portion of the substrate 110.

In certain embodiments, the cover 130 may be printed glass or a high temperature stable polymer material applied directly on the top surface 112 of the substrate 110 and the surfaces of the element layer 120 (including the fuse element 122 and the termination pads 160, 162). In one embodiment, the glass has no metals and may be applied as a thick film. The glass film is dried, then fired, and then cooled. Alternatively, the cover 130 may comprise a layer of ceramic material that is mechanically pressed over the top surface 112 of the substrate 110 to suffuse the underlying components (i.e., the fuse element 122 and the termination pads 160, 162), and the assembly is then fired to cure the cover 130. In yet other embodiments, the cover 130 may comprise a plate of electrically insulating material that is bonded by a layer of bonding material to the top surface 112 over the assembled components. The bonding material may be applied to the top surface 112 to suffuse the top surface 112 and the assembled components as described above, and the cover 130 placed on the bonding material. The cover 130 may act as a passivation layer which has arc quenching characteristics.

Figure 4I:
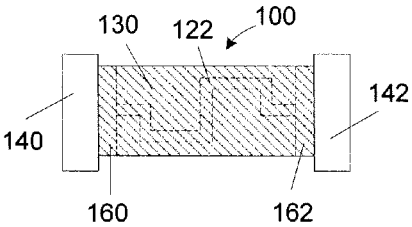
Figure 4J:
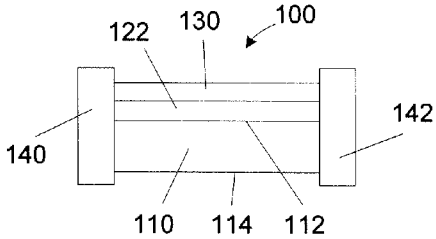

Next at step 350, the circuit protector 100 is terminated. The top view and the side view of the terminated circuit protector 100 are illustrated in FIG. 4I and FIG. 4J, respectively. The termination ends 140, 142 may comprise electrically conductive material coated over the end portions of the circuit protector subassembly after the cover 130 has been coupled thereto. The termination ends 140, 142 may be coated on the circuit protector subassembly in any suitable manner known in the art. By way of example, but not by way of limitation, termination ends 140, 142 may be applied by dipping the end portions of the subassembly in a suitable coating bath followed by firing. The termination ends 140, 142 contact the termination pads 160, 162 at the end portions 116, 117 of the substrate 110. The termination ends 140, 142 preferably extend along the lateral edges 118, 119 of the substrate 110 as far as allowed by industry standards, so that the lateral edges of the termination pads 160, 162 are at least partially enclosed in the termination ends 140, 142. The termination ends 140, 142 also correspondingly extend over a portion of the cover 130 and the bottom surface 114 of the substrate 110. In certain embodiments, the termination ends 140, 142 may be made from silver ink that is then plated with silver tin. Other conducting materials may be used for the termination ends 140, 142 without departing from the scope and spirit of the present invention. Following termination of the circuit protector 100, the method 300 ends at step 360.

Figure 5:
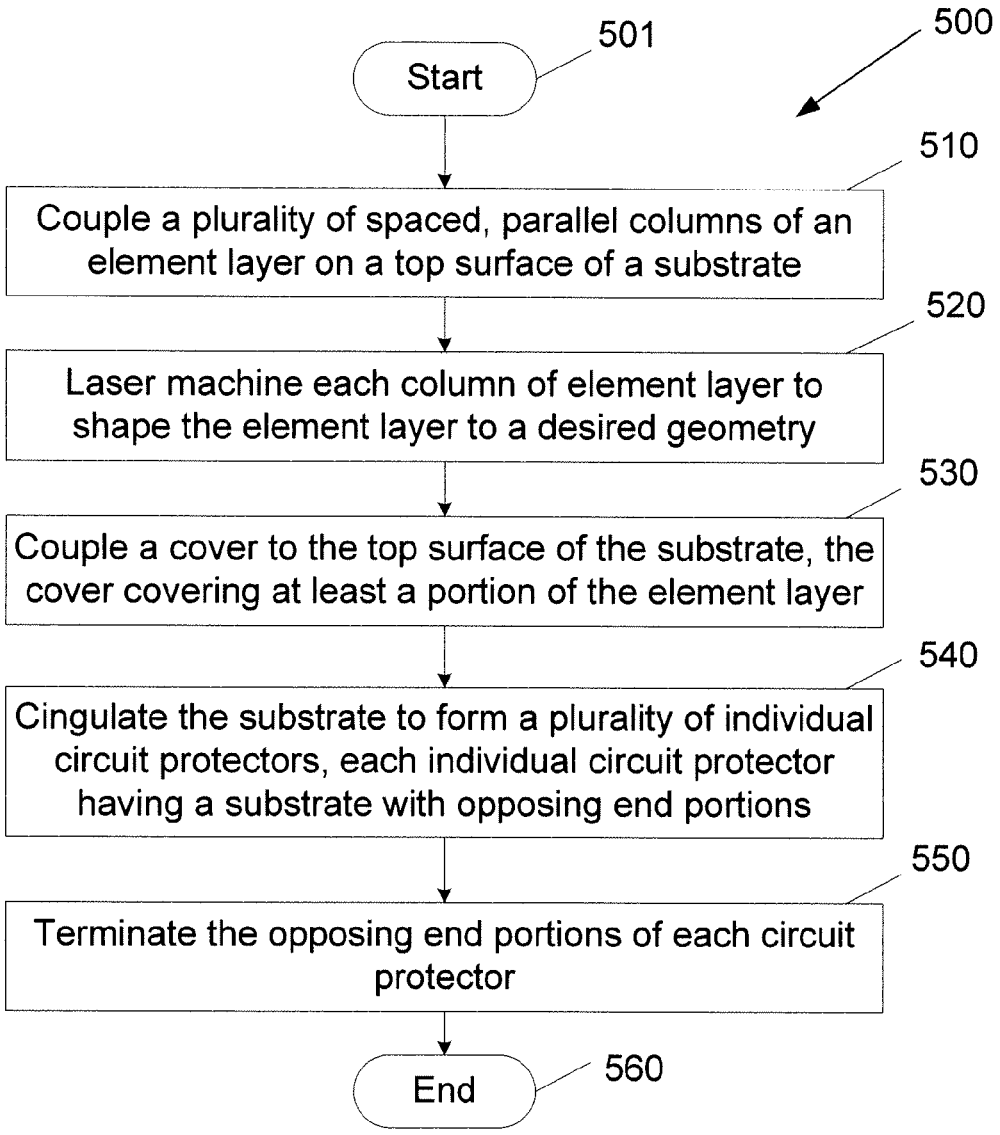
FIG. 5 is a flowchart depicting another exemplary method of manufacturing a plurality of circuit protectors.
Figure 6:
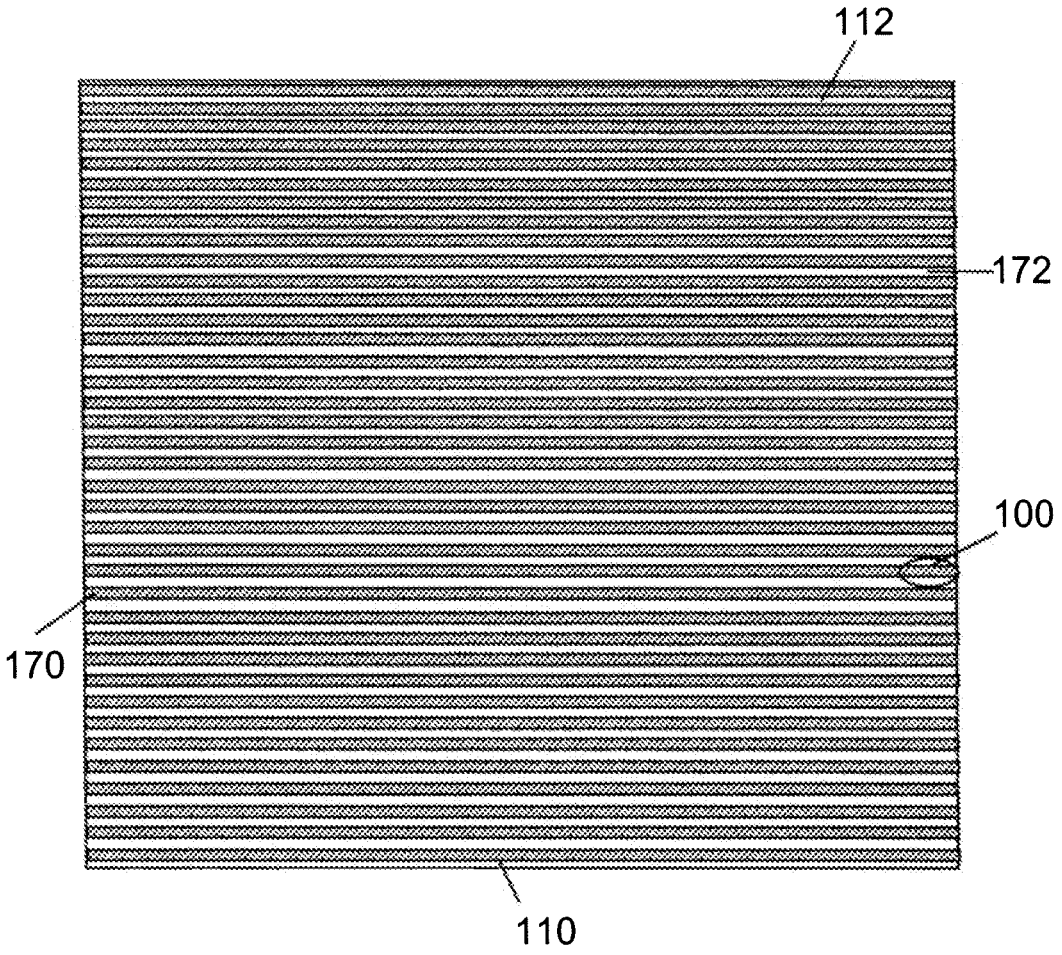
FIG. 6 illustrates a top view of a plurality of spaced, substantially parallel columns of the element layer coupled to a substrate, from which a plurality of circuit protectors may be formed, in accordance with exemplary embodiments of the present invention.

An alternative method for manufacturing a plurality of circuit protectors 100 is described with respect to FIG. 5 and FIG. 6. FIG. 5 is a flowchart depicting another exemplary method 500 of manufacturing a plurality of circuit protectors 100. FIG. 6 a top view of a plurality of spaced, substantially parallel columns of the element layer 120 coupled to a substrate 110, from which a plurality of circuit protectors 100 can be formed, such as in accordance with the exemplary method 500.

The exemplary method 500 of FIG. 5 begins at start step 501 and proceeds to step 510, where a plurality of spaced, substantially parallel columns of an element layer 120 are coupled to the top surface 112 of a substrate 110. FIG. 7 illustrates the plurality of spaced, substantially parallel columns of the element layer 120 coupled to the top surface 112 of the substrate 110. The illustrated substrate 110 has a substantially rectangular cross-section. By way of example, the substrate 110 may be about 2½" to about 3" square, which may be suitable for forming a plurality of circuit protectors 100. Depending on the dimensions of the circuit protectors 100, a single substrate of about 2½" to about 3" square may accommodate approximately 798 circuit protectors. Other sizes and shapes of substrates 110 may alternatively be utilized without departing from the scope and spirit of the present invention.

Exemplary methods for application of the element layer 120 to the substrate 110 have been described above. In certain embodiments, the element layer 120 may be coupled to the top surface 112 of the substrate 110 by forming metallization lines 170 spaced apart on the substrate 110 by areas 172. After the element layer 120 is applied, the element layer 120 is laser machined to shape it into a predetermined geometry at step 520. As described previously, laser machining allows the element layer 120 to be formed into various complex geometries while maintaining edge acuity. The sidewalls of the complex geometry may have a 90° cut.

Next at step 530, the cover 130 is coupled to the top surface 112 of the substrate 110, wherein the cover 130 covers at least a portion of the element layer 120. That is, the cover 130 suffuses at least a portion of the top surface 112 of the substrate 110, the fuse element 122, and at least a portion of the termination pads 160, 162 of each circuit protector 100, and fills any voids around and between them. In an alternative embodiment, the cover 130 suffuses at least a portion of the fuse element 122. Exemplary methods for application of the cover 130 have been described above.

At step 540, the substrate 110 is singularized to form a plurality individual circuit protectors 100, wherein each circuit protector 100 comprises a substrate 110 with opposing end portions 116, 117. For example the plurality of circuit protectors 100 may be singularized from the substrate 110 by dicing horizontally across the substrate 110 along the areas 172 and vertically across the metallization lines 170. According to certain embodiments, such dicing may be performed via a diamond dicing saw. In alternative embodiments, other known methods may be used for singularizing the plurality of circuit protectors 100 from the substrate 110 without departing from the scope and spirit of the present invention.

After the plurality of circuit protectors 100 are singularized from the substrate 110, the opposing end portions 116, 117 of each circuit protector 100 are terminated at step 550. Exemplary methods for terminating the circuit protectors 100 have been described above. After termination of the circuit protectors 100, the exemplary method 500 ends at step 560.

Figure 7A:
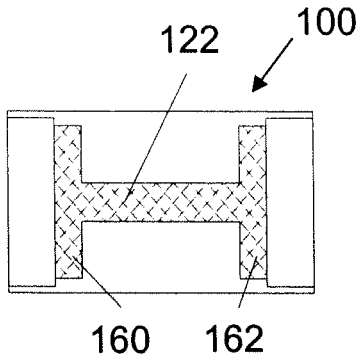
FIGS. 7A-7C illustrate top views of exemplary circuit protectors having fuse elements of various geometries, in accordance with certain exemplary embodiments of the present invention.
Figure 7B:
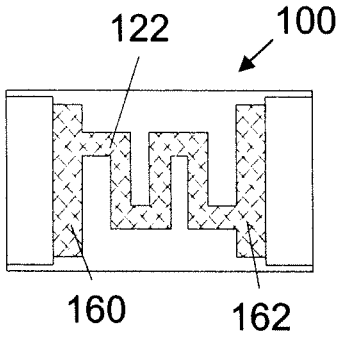
Figure 7C:
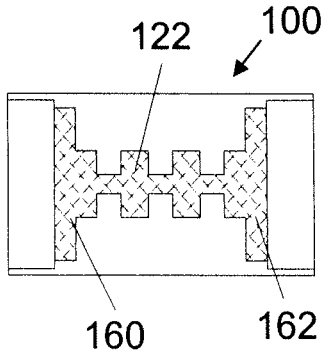

FIGS. 7A-7C illustrate top views of exemplary circuit protectors 100 having fuse elements 122 of various geometries, in accordance with certain exemplary embodiments of the invention. As shown in FIG. 7A, the element layer 120 of the exemplary circuit protector 100 has been laser machined to form a fuse element 122 having a narrow straight line geometry extending from a first termination pad 160 to the second termination pad 162. As shown in FIG. 7B, the element layer 120 of the exemplary circuit protector 100 has been laser machined to form a fuse element 122 having a narrow serpentine geometry extending from a first termination pad 160 to the second termination pad 162. As shown in FIG. 7C, the element layer 120 of the exemplary circuit protector 100 has been laser machined to form a fuse element 122 having a relatively narrow straight line geometry extending from a first termination pad 160 to the second termination pad 162, wherein the relatively narrow straight line geometry further comprises larger rectangular sections therein. Thus, it may be seen that laser machining allows a fuse element 122 to be formed into various complex geometries while maintaining the fine edge acuity.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is, therefore, contemplated that the claims will cover any such modifications or embodiments that fall within the scope of the invention.

What is claimed is:

1. A method of making a circuit protector, comprising the steps of:

providing an electrically insulating substrate having a first major surface and a second major surface opposing the first major surface;

coupling a conductive element layer to the first major surface of the substrate, the coupled conductive element layer having a uniform predetermined thickness and being entirely in direct surface contact with the first major surface of the substrate;

after coupling the conductive element layer, vaporizing only a portion of the conductive element layer from the electrically insulating substrate with a laser and without damaging the electrically insulating substrate and also while leaving the electrically insulation substrate intact, whereby the vaporizing of only the portion of the conductive element layer is performed to fabricate a configuration of a fuse element having a predetermined geometry and a fine edge acuity extending on the first major surface of the electrically insulating substrate.

2. The method of claim 1, wherein coupling the conductive element layer comprises applying a thin film conductive element having a thickness of about 2 microns in direct contact with the first major surface of the electrically insulating substrate.

3. The method of claim 1, wherein coupling the conductive element layer comprises screen printing the conductive element layer in direct contact with the first major surface of the electrically insulating substrate.

4. The method of claim 1, wherein coupling the conductive element layer comprises metalizing an entirety of the first major surface of the electrically insulating substrate.

5. The method of claim 1, wherein vaporizing only the portion of the conductive element layer with a laser is performed to fabricate a configuration of a fuse element having a straight line geometry.

6. The method of claim 1, wherein vaporizing only the portion of the conductive element layer with a laser comprises applying a fiber laser with a pulsed mode of operation to only the portion of the coupled conductive element layer.

7. The method of claim 6, wherein vaporizing only the portion of the conductive element layer with a laser comprises forming the sidewall of the fuse element to extend substantially perpendicular to the first major surface of the electrically insulating substrate.

8. The method of claim 7, wherein vaporizing only the portion of the conductive element layer with a laser further comprises forming at least one of a curve and a right angle in the sidewall of the fuse element.

9. The method of claim 6, wherein vaporizing only the portion of the conductive element layer with a laser comprises applying a fiber laser with a focal point of about 10 to 25 micrometers.

10. The method of claim 1, wherein vaporizing only the portion of the conductive element is performed to fabricate the fuse element with at least one termination pad, and the method further comprises providing at least one termination end electrically connected to the termination pad.

11. The method of claim 1, wherein vaporizing only the portion of the conductive element layer with a laser is performed to fabricate the fuse element with a substantially serpentine geometry.

12. The method of claim 1, wherein vaporizing only the portion of the conductive element layer with a laser is performed to fabricate the fuse element with a geometry comprising a straight line with rectangular sections extending therefrom.

13. The method of claim 1, further comprising forming a cover over at least a portion of the conductive element layer.

14. The method of claim 13, further comprising applying a marking to the cover.

15. The method of claim 1, further comprising terminating the fuse element by applying electrically conductive terminating ends to opposing end portions of the substrate.

16. The method of claim 1, wherein providing the electrically insulating substrate comprises providing one of a ceramic substrate, a glass substrate, a polymer substrate, an FR4 substrate, an alumina substrate, a steatite substrate and a forsterite substrate.

17. The method of claim 1, wherein coupling the conductive element layer to the first major surface of the electrically insulating substrate comprises applying one of silver, gold, palladium silver, copper, nickel, silver alloy, gold alloy, palladium silver alloy, copper alloy or nickel alloy.

18. A method for making a plurality of circuit protectors, comprising the steps of:

providing an electrically insulating substrate having a top surface;

coupling a conductive element layer entirely in direct surface contact with the top surface of the electrically insulating substrate, wherein the conductive element layer includes a plurality of spaced apart and substantially parallel columns of electrically conductive material;

laser machining the conductive element layer to vaporize only a portion of each of the plurality of columns without damaging the underlying electrically insulating substrate and while leaving the substrate intact, wherein the laser machining is performed to configure each column as a fuse element having a predetermined geometry and a sidewall that extends substantially perpendicular to the top surface.

19. The method of claim 18, further comprising covering the top surface and each column of electrically conductive material.

20. The method of claim 19, further comprising:

dividing the covered electrically insulated substrate to form a plurality of individual circuit protectors, each individual protector having opposing end portions; and terminating each of the opposing end portions.

21. The method of claim 18, further comprising applying at least one marking to the individual circuit protectors.

22. The method of claim 18, wherein laser machining the conductive element layer to vaporize only the portion of each of the plurality of columns comprises operating a fiber laser with a pulsed mode of operation.

23. The method of claim 22, wherein operating the fiber laser comprises operating the fiber laser with a focal point of about 10 to 25 micrometers.

24. The method of claim 18, wherein laser machining the conductive element layer to vaporize only the portion of each column is performed to fabricate termination pads connected to the configured fuse element.

25. The method of claim 18, wherein laser machining the conductive element to vaporize only the portion of each column is performed to configure each column as a fuse element having substantially serpentine geometry.

26. The method of claim 18 wherein coupling the conductive element layer on the top surface of the electrically insulating substrate comprises metalizing the top surface of the substrate.

27. The method of claim 26, wherein metalizing the top surface comprises screen printing a conductive ink on the top surface of the electrically insulating substrate.

28. The method of claim 27, wherein metalizing the top surface comprises screen printing with a conductive ink including at least one of silver, gold, palladium silver, copper, nickel, silver alloy, gold alloy, palladium silver alloy, copper alloy or nickel alloy.

29. The method of claim 18, wherein laser machining the conductive element layer to vaporize only the portion of each column is performed to fabricate each column as a fuse element with at least one of a curve and a right angle in the sidewall.

30. A circuit protector product made by the method of claim 1.

31. A circuit protector product made by the method of claim 18.

* * * * *